United States Patent [19]

Wexler

[11] 4,249,338

[45] Feb. 10, 1981

[54] DOLL WITH SOUND GENERATOR AND PLURAL SWITCH MEANS

[76] Inventor: Howard Wexler, 300 E. 40th St., New York, N.Y. 10016

[21] Appl. No.: 97,158

[22] Filed: Nov. 26, 1979

[51] Int. Cl.[3] ..... A63H 33/26

[52] U.S. Cl. ..... 46/232; 46/117

[58] Field of Search ..... 46/232, 117, 118

[56] References Cited

U.S. PATENT DOCUMENTS

| | | | |
|---|---|---|---|
| 3,136,089 | 6/1964 | Gardel et al. | 46/232 X |
| 3,162,980 | 12/1964 | Hellman | 46/232 |
| 3,190,038 | 6/1965 | Kardon | 46/232 X |
| 3,234,687 | 2/1966 | Elwell | 46/117 |
| 3,461,604 | 8/1969 | Glass et al. | 46/232 |
| 3,490,170 | 1/1970 | Wolf | 46/117 |
| 3,514,899 | 6/1970 | Bonanno et al. | 46/118 X |
| 3,563,229 | 2/1971 | Petrusson | 46/232 X |
| 3,641,703 | 2/1972 | Tepper et al. | 46/232 |
| 3,755,960 | 9/1973 | Tepper et al. | 46/232 X |
| 3,758,983 | 9/1973 | Cagen | 46/135 A |
| 3,867,785 | 2/1975 | Ryan et al. | 46/117 |
| 3,918,199 | 11/1975 | De Masi | 46/232 X |
| 4,075,782 | 2/1978 | Neuschatz | 46/118 |

*Primary Examiner*—F. Barry Shay

*Attorney, Agent, or Firm*—Davis, Hoxie, Faithfull & Hapgood

[57] ABSTRACT

A doll comprising a crying sound generator within the doll body, first switch means for actuating the crying sound generator, at least two additional switch means, and automatic selection means for determining which of the additional switch means is connected to stop the crying. The additional switch means may be operated by manipulating the doll, e.g., by giving it a bottle, by changing its diaper, or by picking it up and patting its back. In a play sequence the child actuates the switch to produce crying sounds and then attempts to stop the crying by handling the doll in one of the ways stated. When the child hits upon the type of handling which operates the particular additional switch means selected by the random selector, the crying sounds stop. A short sequence of sighing or cooing sounds may be used at the end of the crying sounds.

15 Claims, 5 Drawing Figures

DOLL WITH SOUND GENERATOR AND PLURAL SWITCH MEANS

Dolls including sound-making devices are well known. Baby dolls which can be actuated by the user to initiate crying and whose crying can also be stopped by the user are one known variety of such dolls. These dolls, however, have—in most, if not all cases—a predictable sound-making behavior. One action will initiate sound-making, and the same or another single action will terminate sound making.

I have invented a doll in which the sound-making behavior is less predictable and more realistic.

Figure 1:
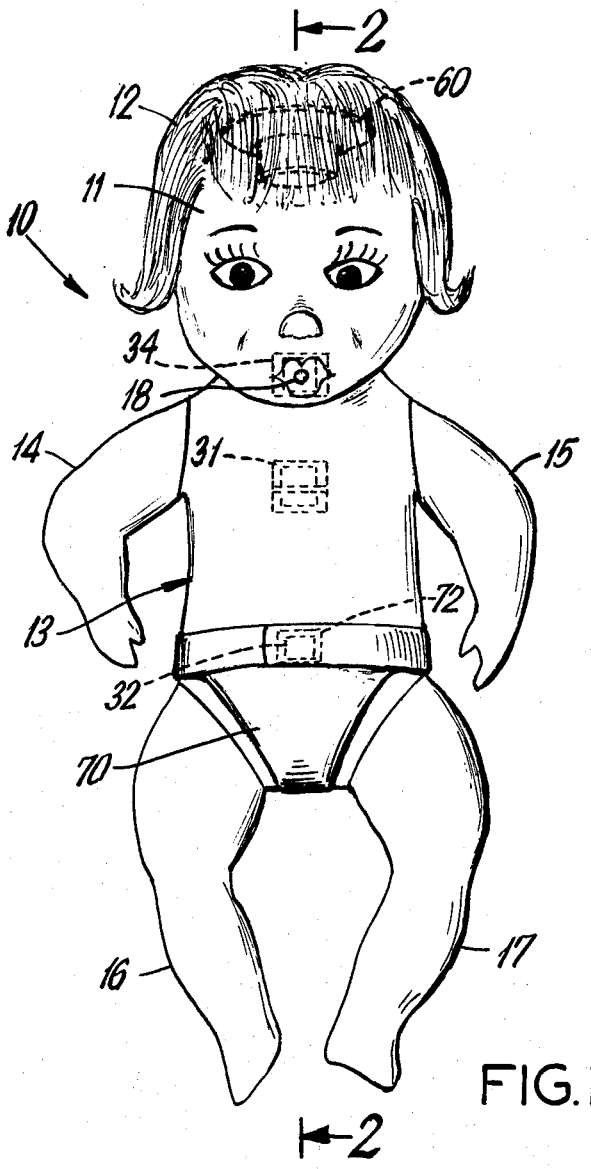
FIG. 1 shows a front view of one embodiment of my invention in the form of a baby doll.

The doll 10 in FIG. 1 has a conventional doll body including a rotatable head 11 with artificial hair 12, a trunk section 13, arms 14, 15 and legs 16, 17. A "Baby-Burps" doll manufactured by Lesney Products was used as the starting point for the doll body of this embodiment.

Figure 2:
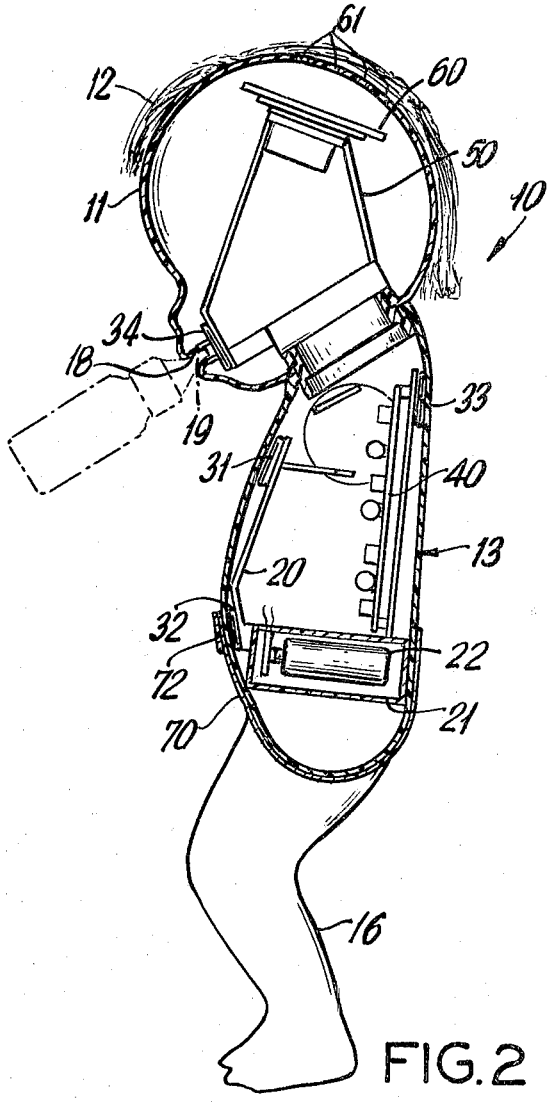
FIG. 2 shows a side cross-sectional view along line 2—2 of the doll body of FIG. 1.

As shown in FIG. 2, a first frame 20 has been inserted within the doll trunk 13. It supports the battery box 21 and the battery 22 contained therein, three pressure actuated switches 31, 32, 33 (proximity actuated switches can also be used), and the electronic circuit 40. The electronic circuit 40 in FIG. 1 is shown in representational fashion, and does not portray the arrangement of electrical components of an actual embodiment. A second frame 50 has been inserted in the doll head 11. It supports a fourth pressure (or proximity) actuated switch 34 within the doll's mouth 18 and a loudspeaker 60. A plurality of holes 61 have been made in the doll head 11, beneath the hair 12, so that the sound from the loudspeaker 60 can reach the user.

Figure 3:
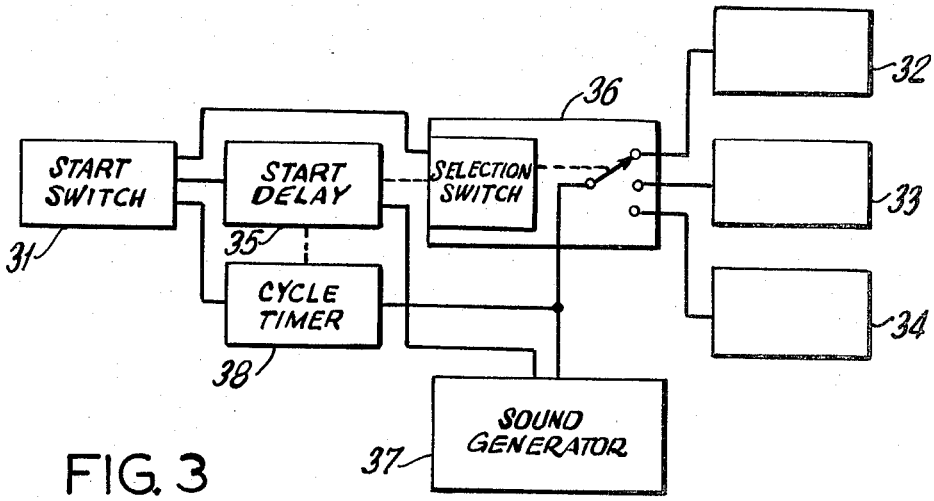
FIG. 3 is a generalized schematic block diagram of the embodiment of FIG. 1.

FIG. 3 illustrates the principles of my invention in block diagram form. The switch 31 in the doll's chest is a start switch actuated by the user.

One stop switch 32 is located in the belly region of the doll trunk 13. The diapers 70 in this embodiment have a fastener, such as Velcro brand fastener 72, in the position which will overlie this stop switch 32 so that the switch 32 can be actuated by fastening the doll's diapers 70.

Another stop switch 33 is located in the upper back of the doll trunk 13, where it can be actuated by patting the doll's back. The third stop switch 34 is located within the doll's mouth opening 18 where it can be actuated by insertion of the baby bottle nipple 19.

Closing of the start switch 31 initiates a start delay circuit 35 and either directly or indirectly (via the start delay circuit 35) actuates the selector circuit 36. Closing of the start switch 31 also initiates a crying sound cycle timer 38 either directly or indirectly via the start delay circuit 35. An output signal from the start delay circuit 35 actuates the sound generator circuit 37 to produce a crying noise. It continues to produce the crying noise until a stop signal is received from that one of the stop switches 32, 33, 34 which is connected at random by the selection switch in the selector circuit 36 to cut off the supply of power to the sound generator circuit 37.

A typical play sequence for use of the doll by a child is as follows. The child places the doll in bed and actuates the start switch 31 by patting or pressing the doll's chest. This may be done, for example, in the process of closing a fastener on the doll's dressing gown (not shown) overlying the start switch 31 before the child lays the doll down to rest. After a delay of 10 to 30 seconds, the length of which is determined at random by the start delay circuit 35, the doll begins to cry. The child then tries to satisfy the doll's simulated need, for example, by placing the nipple 19 of the bottle in the doll's mouth 18. Depending upon the output of the selection switch, this action may or may not stop the crying. In some cases, the crying will be stopped by patting the doll's back (thereby actuating switch 33), as in burping a baby. In other cases, actuating switch 32 in closing the fastener 72 on the doll's diapers 70 overlying the switch 32, in the process of changing the diapers, will stop the crying. When the crying stops, a cooing or sighing sound is produced for several seconds by modification of the crying sound. If the stop switches 32, 33, 34 are not actuated within a predetermined period—such as 3 minutes—the crying cycle will be ended by the cycle timer 38.

Figure 4:
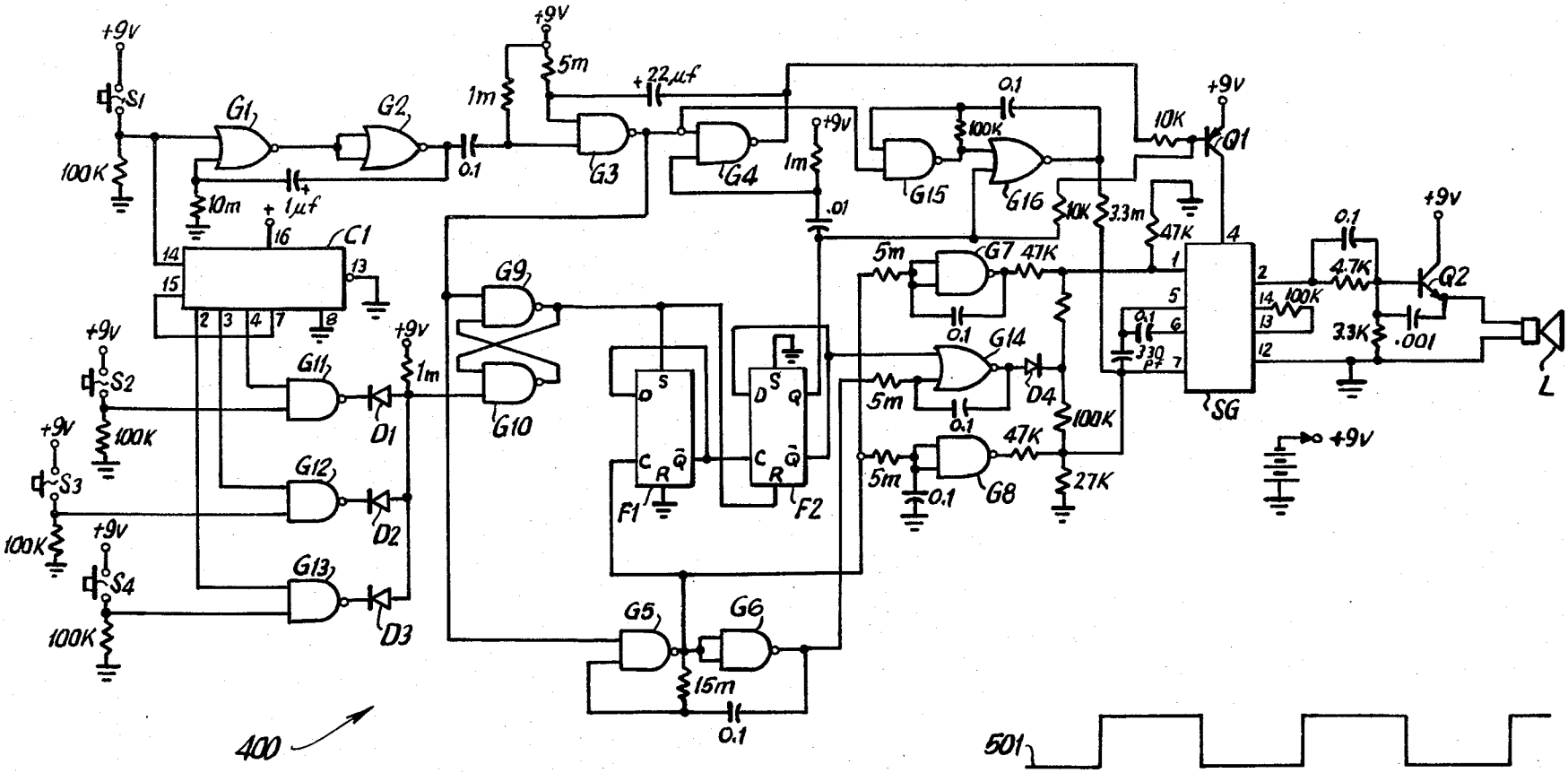
FIG. 4 shows an electronic circuit schematic diagram suitable for the embodiment of FIG. 1.
Figure 5:
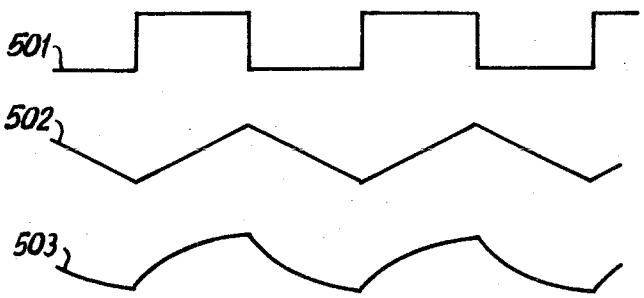
FIG. 5 shows typical waveforms produced by the circuit of FIG. 4.

The circuit 400 of FIG. 4 is one embodiment of a circuit for use in accordance with my invention. When start switch S1 is closed, it applies a logical 1 signal to the input of the start delay circuit comprising NOR gates G1 and G2. (The NOR gates in this embodiment are type No. CD 4001). After a starting delay, of approximately 30 seconds in this embodiment, the output of NOR gate G2 produces a signal which initiates the crying cycle via NAND gates G3 and G4 and transistor Q1 (a 2N4402 in this embodiment), and starts the crying cycle timer comprising NAND gates G3 and G4. (The NAND gates in this embodiment are type No. CD 4011). The crying cycle timer in this embodiment permits crying to continue for up to three minutes, unless the crying is stopped by the activation of the appropriate one of the stop switches S2, S3 or S4, described below.

The crying circuit comprises NAND gates G5, G6, G7 and G8, the sound generator SG, the transistor amplifier Q2, and their associated capacitors and resistors. The sound generator SG used in this embodiment is a type No. XR-2206 manufactured by Exar Integrated Systems, Inc. Its frequency of operation is determined by the capacitance between its pins 5 and 6 and the effective resistance from its pin 7 to ground in accordance with the formula $f_o = 1/RC$ Hz. NAND gates G5 and G6 comprise a very low frequency square wave generator producing a signal having waveform 501 of approximately 9 volt peak-to-peak amplitude. This square wave signal determines the basic repetition rate of the crying sound. NAND gates G7 and G8 and their associated resistors and capacitors are shaping circuits. The circuit of NAND gate G7 changes the square wave signal from NAND gate G5 into a sawtooth waveform 502 having a peak-to-peak amplitude of approximately 6 volts. The output of this saw tooth shaping circuit is connected to the amplitude modulation input, pin 1, of the sound generator SG. The circuit of NAND gate G8 changes the square wave signal from NAND gate G5 into an exponential waveform 503 having a peak-to-peak amplitude of approximately 8 volts. The output of this exponential shaping circuit is connected to the frequency control input, pin 7, of the sound generator SG. Also connected to the frequency control input, pin 7, of the sound generator SG is the output of a low frequency oscillator comprising NAND gate G15 and NOR gate G16. The oscillator produces a frequency of approximately 40 Hz which modulates the crying sound, making it sound more insistent or demanding. The output of the sound generator SG is amplified by transistor Q2 (type No. 2N4400 in this embodiment) and the resulting signal is applied to the loudspeaker L.

The output of counter C1 (a type No. CD 4017 counter in this embodiment) determines which of the three stop switches S2, S3 or S4 (32, 33 or 34 of FIGS. 1-3) is connected to terminate the crying sound. The counter C1 is connected to count pulses on its input pin 14, counting from 1 to 3 and recycling. In this embodiment, a random number of pulses is provided by the contact bounce of switch S1, which is a Flexswitch Series 100 switch manufactured by the Electric Products Division of Sheldahl Co. The counter C1 produces a logical "1" output on one of its pins 2, 3 or 4, depending on its counting state. The NAND gates G11, G12 and G13 are each connected to one of these outputs of the counter and to one of the stop switches S2, S3 or S4. When one of the NAND gates G11, G12 or G13 concurrently receives a logical "1" signal on each of its inputs, it transmits a signal to the stop latch circuit comprising NAND gates G9 and G10. Diodes D1, D2 and D3 isolate the outputs of these NAND gates.

When the stop latch circuit comprising NAND gates G9 and G10 is actuated by a stop signal from one of the NAND gates G11, G12 or G13, the output of NAND gate G9 goes from a logical "1" to "0". This removes the logical "1" signal from the set input S of flip-flop F1 and from the reset input R of flip-flop F2 and permits them to be triggered by pulses at their clock inputs C. (The flip-flops in this embodiment are type No. CD 4013). The crying cycle then in progress (as determined by a pulse from the square wave generator comprising NAND gates G5 and G6) is completed. When flip-flop F1 receives the end of the pulse at its clock input C from NAND gate G5, F1 transmits a pulse from its $\overline{Q}$ output to the clock input C of flip-flop F2. Flip-flop 2 is switched from its reset state to produce a logical "1" at its Q output. This transmits a pulse through the 0.01 ufd capacitor to NAND gate G4, terminating its control over transistor Q1; however, the logical "1" signal Q output of flip-flop F2 temporarily continues the actuation of transistor Q1.

The logical "0" which now appears at the $\overline{Q}$ output of flip-flop F2 actuates a linear sawtooth generator associated with NOR gate G14. This generator generates a waveform almost exactly opposite in phase to the output of NAND gate G7. The output of NAND gate G7, which controls the amplitude of the sound generator, is almost completely cancelled, and the signal at pin 7, which controls the frequency of the sound generator SG, is modified. As a result, the crying sound is transformed into sighs. The next pulse from NAND gate G5 switches flip-flop F1 without producing a pulse at its $\overline{Q}$ output. The following pulse from NAND gate G5 produces a pulse which is transmitted to the clock input C of flip-flop F2, switching its logical "1" output signal from output Q to output $\overline{Q}$, disabling transistor Q1, which cuts off power to the sound generator, terminating the crying cycle after two sighs.

I claim:

1. A doll comprising a doll body, (a) an electrical sound generator within the doll body, first switch means within the doll body for actuating the sound generator, at least two additional switch means within the doll body, each of the additional switch means being individually couplable to the sound generator for actuation to deactivate the sound generator, and automatic selection means within the doll body for randomly determining which of the additional switch means is coupled to the sound generator for deactivating the sound generator.

2. The doll of claim 1 wherein the doll is in the form of a human baby and the sound generator produces a crying noise.

3. The doll of claim 2 wherein the first switch means is located in the chest region of the doll.

4. The doll in claim 2 wherein one of the additional switch means is located at the waist region of the doll.

5. The doll of claim 2 wherein one of the additional switch means is located in the mouth region of the doll.

6. The doll of claim 2 wherein one of the additional switch means is located within the mouth of the doll.

7. The doll of claim 2 wherein one of the additional switch means is located in the upper back region of the doll.

8. The doll of any of claims 1 through 7 wherein the automatic selection means is a random switching circuit.

9. The doll of any of claims 1 through 7 wherein the automatic selection means is programmed with a pseudo-random switching program.

10. The doll of any of claims 1 through 7 further, comprising a delay circuit connected to the first switch means for delaying the actuation of the sound generator.

11. The doll of claim 10 wherein the delay circuit produces a delay of random length within predetermined limits.

12. The doll of claim 10 further comprising a second delay circuit actuated by the first switch means and connected to deactivate the sound generator after a delay from initial actuation.

13. The doll of any of claims 1 through 7 further comprising a delay circuit actuated by the first switch means and connected to deactivate the sound generator after a delay from initial actuation.

14. The doll of any of claims 1-7 wherein the automatic selection means is a random switching circuit and further comprising a delay circuit connected to the first switch means for delaying the actuation of the sound generator.

15. The doll of claim 14 wherein the sound generator is also capable of generating a sighing noise, the doll further including means associated with the sound generator for causing the sound generator to produce a sighing noise immediately after deactivation.

* * * * *